US007431562B2

(12) United States Patent
Hooper et al.

(10) Patent No.: US 7,431,562 B2
(45) Date of Patent: Oct. 7, 2008

(54) METHOD AND APPARATUS FOR COOLING GAS TURBINE ROTOR BLADES

(75) Inventors: Tyler F. Hooper, Amesbury, MA (US); Bhanu Reddy, Boxford, MA (US); Gaoqiu Zhu, Billerica, MA (US); Robert F. Manning, Newburyport, MA (US)

(73) Assignee: General Electric Company, Schenectady, NY (US)

( * ) Notice: Subject to any disclaimer, the term of this patent is extended or adjusted under 35 U.S.C. 154(b) by 241 days.

(21) Appl. No.: 11/314,756

(22) Filed: Dec. 21, 2005

(65) Prior Publication Data

US 2007/0140851 A1 Jun. 21, 2007

(51) Int. Cl.
*F01D 5/08* (2006.01)

(52) U.S. Cl. ..... 416/97 R

(58) Field of Classification Search ..... 416/97 R, 416/92; 415/115

See application file for complete search history.

(56) References Cited

U.S. PATENT DOCUMENTS 5,462,405 A * 10/1995 Hoff et al. ..... 416/97 R
5,660,524 A 8/1997 Lee et al.
6,126,396 A 10/2000 Doughty et al.
6,220,817 B1 4/2001 Durgin et al.
6,224,336 B1 * 5/2001 Kercher ..... 416/97 R
6,347,923 B1 2/2002 Semmler et al.
6,471,479 B2 10/2002 Starkweather
6,491,496 B2 12/2002 Starkweather
6,561,758 B2 5/2003 Rinck et al.
6,609,884 B2 * 8/2003 Harvey ..... 415/115
6,672,836 B2 * 1/2004 Merry ..... 416/97 R
6,955,523 B2 10/2005 McClelland
6,960,060 B2 11/2005 Lee
6,981,742 B1 1/2006 Hsiao
7,097,419 B2 * 8/2006 Lee et al. ..... 415/115

* cited by examiner

*Primary Examiner*—Ninh H Nguyen
(74) *Attorney, Agent, or Firm*—William Scott Andes, Esq.; Armstrong Teasdale LLP

(57) ABSTRACT

Methods and apparatus for cooling gas turbine rotor blades is provided. The rotor blades include an airfoil having a pressure sidewall and a second suction sidewall connected together at a leading edge and a trailing edge, such that an internal three pass serpentine cooling circuit is formed therebetween. The cooling circuit includes radially extending first, second, and third serpentine cooling cavities partially separated by, in axially aft succession, a first radially extending internal rib and a second internal rib. The second rib includes a radially inner first portion and a radially outer portion wherein the radially outer portion is angled obliquely with respect to the first portion.

18 Claims, 3 Drawing Sheets

METHOD AND APPARATUS FOR COOLING GAS TURBINE ROTOR BLADES

BACKGROUND OF THE INVENTION

This invention relates generally to gas turbine engines and more particularly, to methods and apparatus for cooling gas turbine engine rotor assemblies.

Turbine rotor assemblies typically include at least one row of circumferentially-spaced rotor blades. Each rotor blade includes an airfoil that includes a pressure side, and a suction side connected together at leading and trailing edges. Each airfoil extends radially outward from a rotor blade platform. Each rotor blade also includes a dovetail that extends radially inward from a shank extending between the platform and the dovetail. The dovetail is used to mount the rotor blade within the rotor assembly to a rotor disk or spool. Known blades are hollow such that an internal cooling cavity is defined at least partially by the airfoil, platform, shank, and dovetail.

At least some known high pressure turbine blades include an internal cooling cavity that is serpentine such that a path of cooling gas is channeled radially outward to the blade tip where the flow reverses direction and flows back radially inwardly toward the blade root. The flow may exit the blade through the root or the flow may be directed to holes in the trailing edge to permit the gas to flow across a surface of the trailing edge for cooling the trailing edge. In cooled turbine blades, the internal pressure of cooing air is attempted to be maintained greater than the local external pressure in the area of the blade. The amount by which the internal pressure exceeds the external pressure is typically referred to as positive Back Flow Margin (BFM). Having a positive BFM prevents hot gas ingestion into the blade interior in the event of a breached wall or severe cycle deterioration.

Furthermore, the aft tip region typically operates at an elevated temperature with respect to the rest of the blade such that film cooling in this area is desirable to improve blade life. In some known blades this film cooling is provided by using film holes in flow communication with a third or aftmost cavity in the cooling circuit. However, adequate internal pressure in the third cavity may not be able to be maintained in all cases. The second cavity or the cavity adjacent and upstream of the third cavity has adequate pressure but is located too far forward to be able to provide film cooling where it is needed.

BRIEF DESCRIPTION OF THE INVENTION

In one embodiment, a gas turbine rotor blade includes an airfoil having a pressure sidewall and a second suction sidewall connected together at a leading edge and a trailing edge, such that an internal three pass serpentine cooling circuit is formed therebetween. The cooling circuit includes radially extending first, second, and third serpentine cooling cavities partially separated by, in axially aft succession, a first radially extending internal rib and a second internal rib. The second rib includes a radially inner first portion and a radially outer portion wherein the radially outer portion is angled obliquely with respect to the first portion.

In another embodiment, a method for cooling a gas turbine engine turbine blade is provided. The turbine blade includes an airfoil having a pressure sidewall and a suction sidewall connected together at a leading edge and a trailing edge, and a cooling circuit including radially extending first, second, and third serpentine cooling cavities partially separated by, in axially aft succession, a first radially extending internal rib and a second internal rib such that an internal three pass serpentine cooling circuit is formed that extends between a dovetail of the blade and a tip of the blade. The second rib includes a radially inner first portion and a radially outer portion wherein the radially outer portion is angled obliquely with respect to the first portion. The method includes providing a flow of a cooling gas to the blade through a cooling gas inlet, channeling the flow of the cooling gas through the first cavity using the first rib, channeling the flow of the cooling gas into the second cavity using the second rib, and directing at least a portion of the flow of the cooling gas through at least one film hole communicatively coupled between the second cavity and an external surface of the pressure sidewall.

In yet another embodiment, a gas turbine engine assembly includes a compressor, a combustor, and a turbine coupled to the compressor the turbine including a rotor blade that includes an airfoil having a pressure sidewall and a suction sidewall connected together at a leading edge and a trailing edge, such that an internal three pass serpentine cooling circuit is formed therebetween, the cooling circuit including radially extending first, second, and third serpentine cooling cavities partially separated by, in axially aft succession, a first radially extending internal rib and a second internal rib. The second rib includes a radially inner first portion and a radially outer portion wherein the radially outer portion is angled obliquely with respect to the first portion.

DETAILED DESCRIPTION OF THE INVENTION

Figure 1:
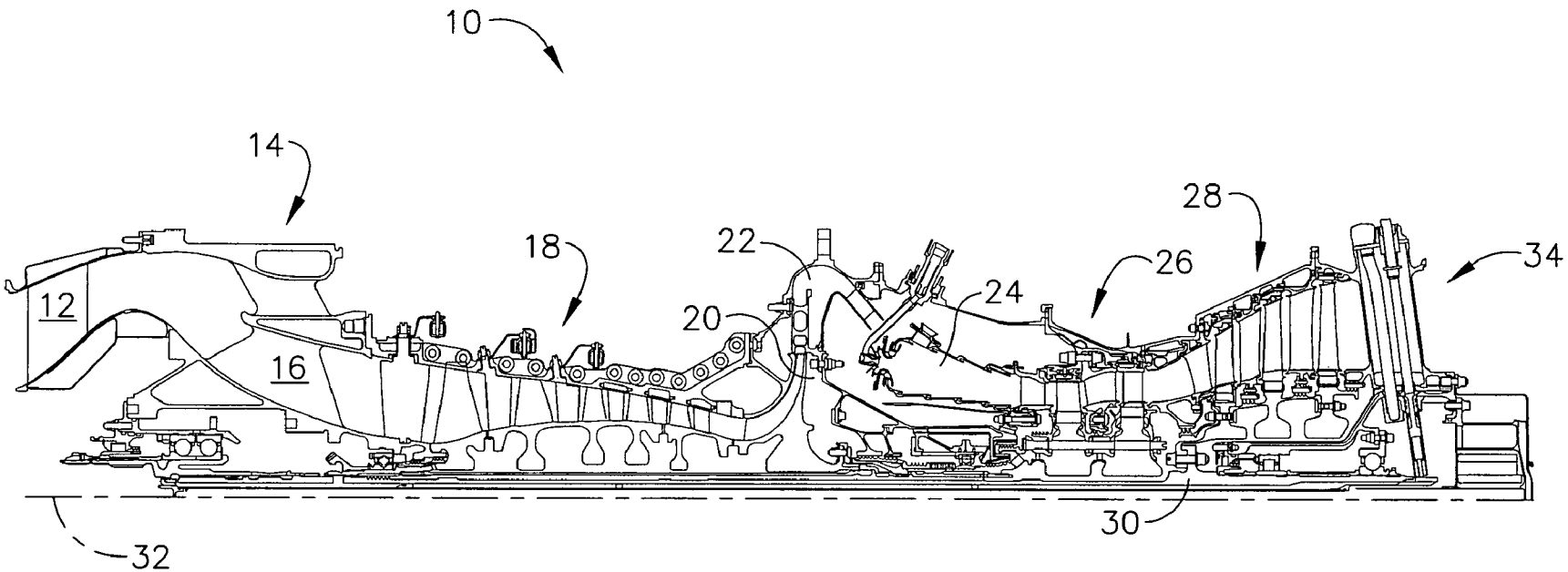
FIG. 1 is a schematic illustration of an exemplary gas turbine engine.

FIG. 1 is a schematic cross-sectional illustration of a gas turbine engine 10 including an inlet 12, an inlet particle separator 14, core inlet guide vanes 16. Engine 10 also includes in serial flow communication an axial compressor 18, a radial compressor 20 or impellor, and a deswirler diffuser 22. Downstream from deswirler diffuser 22 is a combustor 24, a high pressure turbine 26 and a power turbine 28.

In operation, air flows through inlet 12 to axial compressor 18 and to radial compressor 20. The highly compressed air is delivered to combustor 24. The combustion exit gases are delivered from combustor 24 to high pressure turbine 26 and power turbine 28. Flow from combustor 24 drives high pressure turbine 26 and power turbine 28 coupled to a rotatable main turbine shaft 30 aligned with a longitudinal axis 32 of gas turbine engine 10 in an axial direction and exits gas turbine engine 10 through an exhaust system 34.

Figure 2:
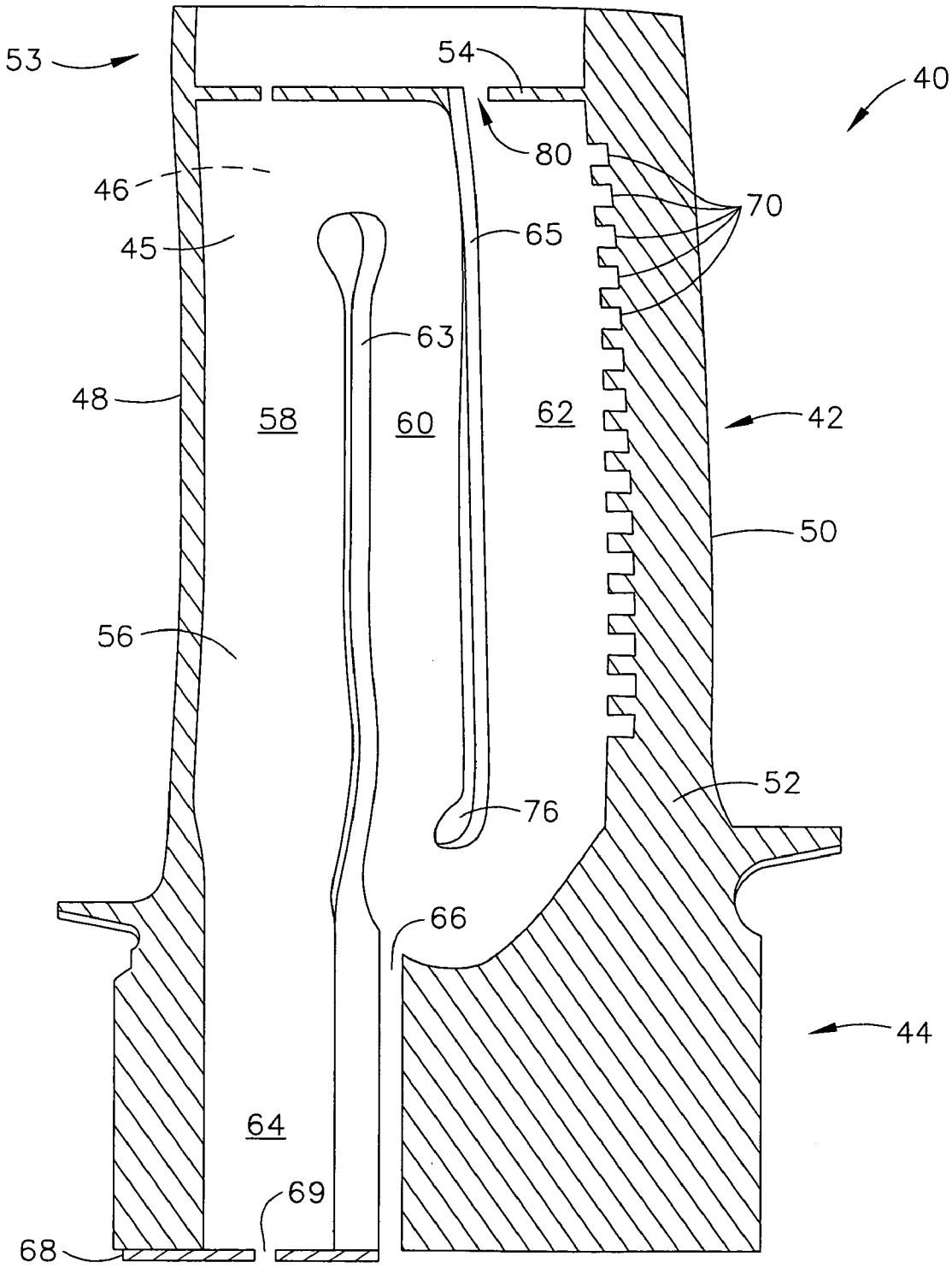
FIG. 2 (PRIOR ART)
FIG. 2 is a perspective internal schematic illustration of a known rotor blade that may be used with the gas turbine engine shown in FIG. 1.

FIG. 2 is a perspective internal schematic illustration of a known rotor blade 40 that may be used with gas turbine engine 10 (shown in FIG. 1). In an exemplary embodiment, a plurality of rotor blades 40 form a high pressure turbine rotor blade stage (not shown) of gas turbine engine 10. Each rotor blade 40 includes a hollow airfoil 42 and an integral dovetail 44 used for mounting airfoil 42 to a rotor disk (not shown) in a known manner.

Airfoil 42 includes a first sidewall 45 (shown cutaway) and a second sidewall 46. First sidewall 45 is convex and defines a suction side of airfoil 42, and second sidewall 46 is concave and defines a pressure side of airfoil 42. Sidewalls 45 and 46 are connected at a leading edge 48 and at an axially-spaced trailing edge 50 of airfoil 42 that is downstream from leading edge 48.

First and second sidewalls 45 and 46, respectively, extend longitudinally or radially outward to span from a blade root 52 positioned adjacent dovetail 44 to a squeeler tip 53 comprising a tip plate 54 that recessed with respect to a blade end 55. Tip plate 54 defines a radially outer boundary of an internal cooling chamber 56. Cooling chamber 56 is defined within airfoil 42 between sidewalls 45 and 46. In the exemplary embodiment, cooling chamber 56 includes a serpentine passage comprising a first cavity 58, a second cavity 60 and a third cavity 62 cooled with compressor bleed air. First cavity 58 and second cavity 60 are separated by a first rib 63 extending radially outward from root 52 towards tip 54. A second rib 65 extends radially inward from tip 54 towards root 52 and spaced axially downstream from rib 63. Second rib 65 separates cavity 60 from cavity 62. An inlet passage 64 is configured to channel air into first cavity 58 and then around first rib 63 into second cavity 60. A refresher hole 66 couples second cavity 60 to the compressor bleed air. Refresher hole 66 is formed using an electrical discharge machining (EDM) process that generates stress concentration at the sharp edge surrounding the openings of refresher hole 66 and generates recast layer/micro-cracks associated with the EDM process. A downstream end of third cavity 62 is in flow communication with a plurality of trailing edge holes 70 which extend longitudinally (axially) along trailing edge 50. Particularly, trailing edge holes 70 extend along pressure side wall 46 to trailing edge 50.

In operation, cooling air is supplied to blade 40 from compressor bleed air through inlet 64 and refresher hole 66. Air entering blade 40 through inlet 64 is directed through first cavity 58, a round rib 63 and into second cavity 60. Refresher hole 66 permits cooler compressor bleed air to enter chamber 56 between second cavity 60 and third cavity 62 proximate a radially inner end 76 of rib 65. The cooler air entering from refresher hole 66 facilitates reducing the temperature and increasing the pressure of the cooling air entering third cavity 62. The cooler air and increased pressure facilitate cooling trailing edge 50 through holes 70. Air entering first cavity 58 is metered using a meter plate 68, which includes a hole 69 of a predetermined size. The flow and pressure in first cavity 58 is adjusted by grinding metering plate 68 from dovetail 44 and installing a new metering plate 68 with a different diameter hole 69. The flow and pressure in third cavity 62 is adjusted by modifying the size of hole 66.

During fabrication of blade 40, a casting core (not shown) is used to form the shape of blade 40 inside a mold. The casting core includes a relatively large tip support in third cavity 62. Accordingly, a relatively large area tip hole 80 is used to remove the core after casting. Tip hole 80 tends to reduce the back flow margin in third cavity 62 such that adding film holes to aid film cooling of the blade tip may result in a low pressure feeding the film holes from third cavity 62. Such low pressure may lead to hot gas ingestion causing additional distress to the blade tip.

Figure 3:
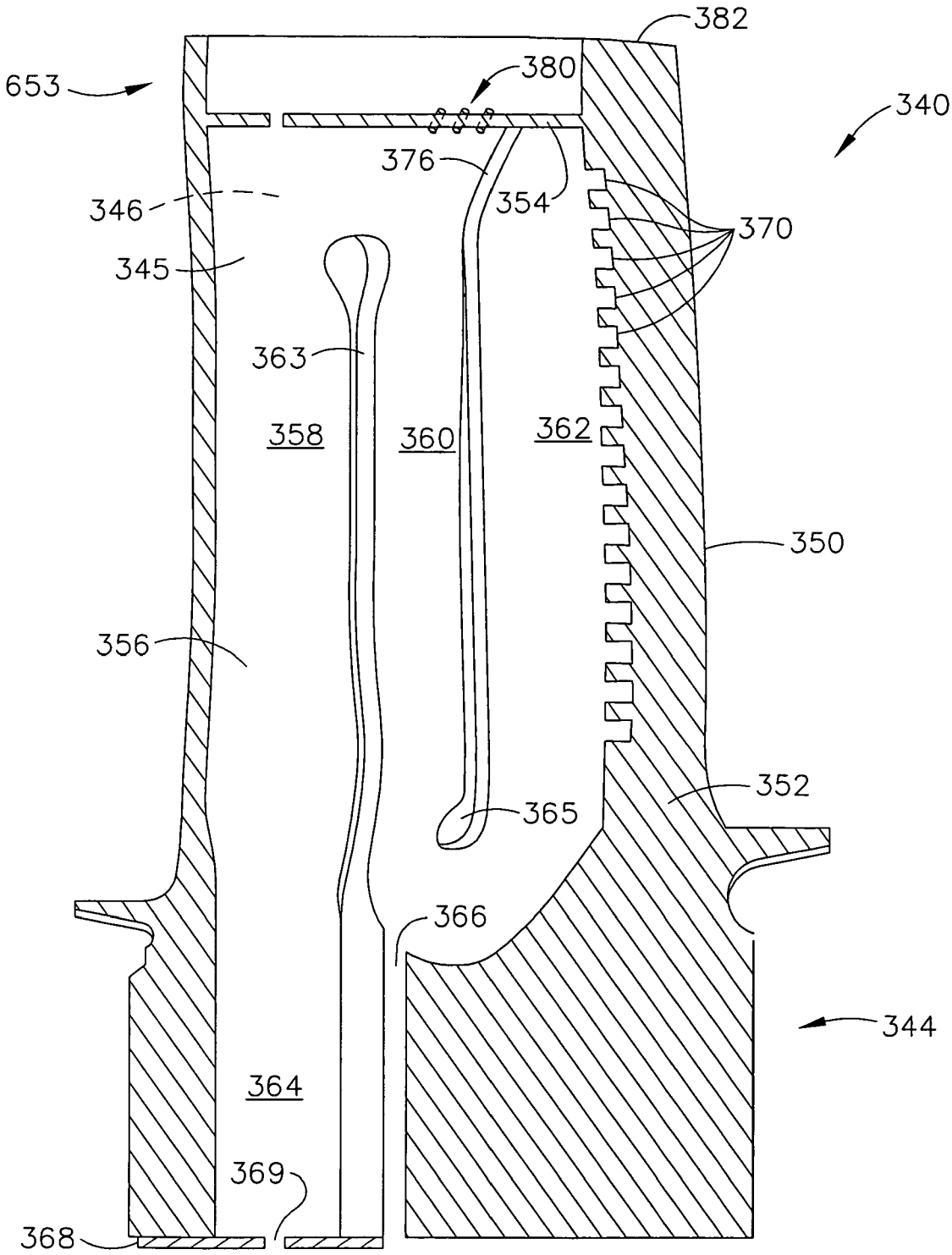
FIG. 3 is a perspective internal schematic illustration of a rotor blade in accordance with an exemplary embodiment of the present invention.

FIG. 3 is a perspective internal schematic illustration of a rotor blade 340 in accordance with an exemplary embodiment of the present invention. In an exemplary embodiment, cast pressure side cooling slots are used for core support during fabrication such that tip core support hole 80 is eliminated and the internal rib between second cavity and third cavity is curved towards the third cavity such that film cooling holes are supplied cooling air from the second cavity to maintain a higher internal pressure for a majority of the blade tip.

Airfoil 342 includes a first sidewall 345 (shown cutaway) and a second sidewall 346. First sidewall 345 is convex and defines a suction side of airfoil 342, and second sidewall 346 is concave and defines a pressure side of airfoil 342. Sidewalls 345 and 346 are connected at a leading edge 348 and at an axially-spaced trailing edge 350 of airfoil 342 that is downstream from leading edge 348.

First and second sidewalls 345 and 346, respectively, extend longitudinally or radially outward to span from a blade root 352 positioned adjacent dovetail 344 to a squeeler tip 353 comprising a tip plate 54 that is recessed with respect to a blade end 355. Tip plate 354 defines a radially outer boundary of an internal cooling chamber 356. Cooling chamber 356 is defined within airfoil 342 between sidewalls 345 and 346. In the exemplary embodiment, cooling chamber 356 includes a serpentine passage comprising a first cavity 358, a second cavity 360 and a third cavity 362 cooled with compressor bleed air. First cavity 358 and second cavity 360 are separated by a first rib 363 extending radially outward from root 352 towards tip 354. A second rib 365 extends radially inward from tip 354 towards root 352 and spaced axially downstream from rib 363. Second rib 365 separates cavity 360 from cavity 362. A radially out end 376 of rib 365 is curved towards cavity 362 such that end 376 intersects tip plate 354 farther aft or downstream than rib 65 intersects tip plate 54 (shown in FIG. 2). One or more tip film holes 380 extend through sidewall 346 to permit cooling air from cavity 360 to exit blade 340 and form a cooling film at a blade end 355. Tip film holes 380 extend through sidewall 346 from a point radially inward from tip plate 354 to an exit point on sidewall 345 that is radially outward from tip plate 354. An inlet passage 364 is configured to channel air into first cavity 358, around rib 363 and then into second cavity 360. A refresher hole 366 couples second cavity 360 to compressor discharge air. Refresher hole 366 is formed using an electrical discharge machining (EDM) process. A downstream end of third cavity 362 is in flow communication with a plurality of trailing edge holes 370 which extend longitudinally (axially) along trailing edge 350. Particularly, trailing edge holes 370 extend along pressure side wall 346 to trailing edge 350.

In operation, cooling air is supplied to blade 340 from compressor discharge air through inlet 364 and refresher hole 366. Air entering blade 340 through inlet 364 is directed through first cavity 358, around rib 363, and into second cavity 360. A portion of the air entering cavity 360 is channeled out of blade 340 through holes 380. The exited air forms a film of relatively cool air at tip 382 and the film extends from sidewall 346, over tip 382 and onto sidewall 345 such that a radially outer portion of sidewall 346, a portion of tip 382, and a portion of a radially outer portion of sidewall 345 is facilitated being cooled using the film. Curving end 376 permits locating holes 380 in a position such that the film formed over tip 382 provides a predetermined amount of cooling to tip 382. Additionally, providing air at the entrance of cavity 360 to form the film improves BFM and cooling efficiency.

Refresher hole 366 permits compressor discharge air that is cooler than the air in cavity 360 to enter chamber 356 between second cavity 360 and third cavity 362. The cooler air reduces the temperature and increases the pressure of the air entering third cavity 362. The cooler air and increased pressure facilitate cooling trailing edge 350 through holes 370. Air entering first cavity 358 is metered using a meter plate 368, which includes a hole 369 of a predetermined size. The flow and pressure in first cavity 358 is adjusted by grinding metering plate 368 from dovetail 344 and installing a new metering plate 368 with a different diameter hole 369. The flow and pressure in third cavity 362 is adjusted by modifying the size of hole 366. However, the velocity of the air passing through hole 366 is relativity high causing the air temperature of the air entering third cavity 362 to be higher than the temperature of the air entering hole 366 such that a cooling efficiency of the refresher air is less than optimal.

The above-described internal aft curved rib is a cost-effective and highly reliable method for providing a source of film cooling air the blade aft tip region that is higher in pressure and lower in temperature than prior art blades. Accordingly, the internal aft curved rib facilitates operating gas turbine engine components, in a cost-effective and reliable manner.

While the invention has been described in terms of various specific embodiments, those skilled in the art will recognize that the invention can be practiced with modification within the spirit and scope of the claims.

What is claimed is:

1. A rotor blade for a gas turbine engine, wherein the rotor blade includes an airfoil having a pressure sidewall and a suction sidewall connected together at a leading edge and a trailing edge, such that an internal three pass serpentine cooling circuit is formed therebetween, said cooling circuit comprising radially extending first, second, and third serpentine cooling cavities partially separated by, in axially aft succession, a first radially extending internal rib and a second internal rib wherein said second internal rib comprises a radially inner portion and a radially outer portion wherein said radially outer portion is angled obliquely with respect to said radially inner portion and is angled aftward with respect to said blade.

2. A blade in accordance with claim 1 wherein said airfoil extends between a blade root and a radially outer blade end and wherein said radially inner portion extends in a substantially radial direction between the blade root and said radially outer portion.

3. A blade in accordance with claim 1 further comprising a squealer tip comprising a tip plate extending substantially circumferentially between said pressure sidewall and suction sidewall.

4. A blade in accordance with claim 3 wherein said radially outer portion extends between said radially inner portion and said tip plate.

5. A blade in accordance with claim 1 further comprising a film cooling hole extending through said pressure sidewall such that said second cavity is in flow communication with an external surface of said pressure sidewall.

6. A blade in accordance with claim 1 further comprising a film cooling hole extending through said pressure sidewall such that a cooling film is generated that extends from said film cooling hole radially outward towards a tip of said pressure sidewall.

7. A blade in accordance with claim 1 further comprising a squealer tip comprising a tip plate extending substantially circumferentially between said first sidewall and second sidewall, said blade further comprising a film cooling hole comprising a first opening formed radially inward from said tip plate and a second opening formed radially outward from said tip plate.

8. A method for cooling a gas turbine engine turbine blade wherein the turbine blade includes an airfoil having a pressure sidewall and a suction sidewall connected together at a leading edge and a trailing edge, and a cooling circuit comprising radially extending first, second, and third serpentine cooling cavities partially separated by, in axially aft succession, a first radially extending internal rib and a second internal rib such that an internal three pass serpentine cooling circuit is formed that extends between a dovetail of the blade and a tip of the blade wherein said second rib comprises a radially inner first portion and a radially outer portion wherein said radially outer portion is angled obliquely with respect to said first portion, said method comprising:

providing a flow of a cooling gas to the blade through a cooling gas inlet;

channeling the flow of the cooling gas through the first cavity using the first rib; and channeling the flow of the cooling gas into said second cavity using the second rib; and directing at least a portion of the flow of the cooling gas through at least one film hole communicatively coupled between said second cavity and an external surface of the pressure sidewall.

9. A method in accordance with claim 8 wherein directing at least a portion of the flow of the cooling gas through at least one film hole comprises directing at least a portion of the flow of the cooling gas through at least one film hole such that a film of cooling air is generated adjacent to at least a portion of the pressure sidewall.

10. A method in accordance with claim 9 wherein directing at least a portion of the flow of the cooling gas through at least one film hole comprises directing at least a portion of the flow of the cooling gas through at least one film hole such that a film of cooling air is generated that extends from at least a portion of the pressure sidewall to at least a portion of the tip.

11. A method in accordance with claim 10 wherein directing at least a portion of the flow of the cooling gas through at least one film hole comprises directing at least a portion of the flow of the cooling gas through at least one film hole such that a film of cooling air is generated that extends from at least a portion of the pressure sidewall to at least a portion of the suction sidewall.

12. A method in accordance with claim 8 wherein directing at least a portion of the flow of the cooling gas through the at least one film hole comprises directing at least a portion of the flow of the cooling gas radially outward through the film hole.

13. A gas turbine engine assembly comprising:

a compressor;

a combustor; and a turbine coupled to said compressor said turbine comprising a rotor blade that includes an airfoil having a pressure sidewall and a suction sidewall connected together at a leading edge and a trailing edge, such that an internal three pass serpentine cooling circuit is formed therebetween, said cooling circuit comprising radially extending first, second, and third serpentine cooling cavities partially separated by, in axially aft succession, a first radially extending internal rib and a second internal rib wherein said second internal rib comprises a radially inner portion and a radially outer portion wherein said radially outer portion is angled obliquely with respect to said radially inner portion and is angled aftward with respect to said blade.

14. A gas turbine engine assembly in accordance with claim 13 wherein said airfoil extends between a blade root and a radially outer blade end and wherein said radially inner portion extends in a substantially radial direction between said blade root and said radially outer portion.

15. A gas turbine engine assembly in accordance with claim 13 further comprising a squealer tip comprising a tip plate extending substantially circumferentially between said pressure sidewall and suction sidewall wherein said radially outer portion extends between said radially inner portion and said tip plate.

16. A gas turbine engine assembly in accordance with claim 13 further comprising a film cooling hole extending through said pressure sidewall such that said second cooling cavity is in flow communication with an external surface of said pressure sidewall.

17. A gas turbine engine assembly in accordance with claim 13 further comprising a film cooling hole extending through said pressure sidewall such that a cooling film is generated that extends from said film cooling hole radially outward towards a tip of said pressure sidewall.

18. A gas turbine engine assembly in accordance with claim 13 further comprising a squealer tip comprising a tip plate extending substantially circumferentially between said pressure sidewall and suction sidewall, said blade further comprising a film cooling hole comprising a first opening formed radially inward from said tip plate and a second opening formed radially outward from said tip plate.

* * * * *